US009984644B2

(12) United States Patent
Yamazaki et al.

(10) Patent No.: US 9,984,644 B2
(45) Date of Patent: May 29, 2018

(54) LIQUID CRYSTAL DISPLAY DEVICE AND METHOD FOR DRIVING THE SAME

(71) Applicant: SEMICONDUCTOR ENERGY LABORATORY CO., LTD., Atsugi-shi, Kanagawa-ken (JP)

(72) Inventors: Shunpei Yamazaki, Tokyo (JP); Jun Koyama, Kanagawa (JP); Yoshiharu Hirakata, Kanagawa (JP); Hiroyuki Miyake, Kanagawa (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 641 days.

(21) Appl. No.: 13/949,273

(22) Filed: Jul. 24, 2013

(65) Prior Publication Data

US 2014/0043315 A1 Feb. 13, 2014

(30) Foreign Application Priority Data

Aug. 8, 2012 (JP) ..... 2012-175997

(51) Int. Cl.
*G09G 3/36* (2006.01)

(52) U.S. Cl.
CPC ..... *G09G 3/3696* (2013.01); *G09G 3/3614* (2013.01); *G09G 3/3648* (2013.01);
(Continued)

(58) Field of Classification Search
CPC .. G09G 3/3614; G09G 3/3659; G09G 3/3655; G09G 3/2025; G09G 3/3685;
(Continued)

(56) References Cited

U.S. PATENT DOCUMENTS 6,452,579 B1 * 9/2002 Itoh ..... G09G 3/3648 345/100
6,650,311 B1 11/2003 Mori
(Continued)

FOREIGN PATENT DOCUMENTS

JP 2002-278523 A 9/2002
JP 2011-141523 A 7/2011
(Continued)

OTHER PUBLICATIONS

Tsuda et al., "Ultra Low Power Consumption Technologies for Mobile TFT-LCDs", IDW '02 : Proceedings of the 9th International Display Workshops, 2002, pp. 295-298.

*Primary Examiner* — Nalini Mummalaneni
(74) *Attorney, Agent, or Firm* — Nixon Peabody LLP; Jeffrey L. Costellia

(57) ABSTRACT

Power consumed in a liquid crystal display device owing to inversion driving is reduced. A control circuit generates a polarity control signal whose potential level is switched at intervals of two or more frame periods. A data line driver circuit processes an image signal to generate a data signal. The data signal has a polarity corresponding to the potential level of the polarity control signal. The control circuit stops output of the image signal to the data line driver circuit when determining that there is no motion in data of the image signal. The control circuit controls a scan line driver circuit and the data line driver circuit, thereby performing, in response to a change in the potential level of the polarity control signal, rewriting of a display portion at least in one frame period during a period in which the output of the image signal is stopped.

7 Claims, 10 Drawing Sheets

(52) U.S. Cl.
CPC ... *G09G 2310/065* (2013.01); *G09G 2310/08* (2013.01); *G09G 2330/02* (2013.01)

(58) Field of Classification Search
CPC .. G09G 3/3611; G09G 3/3696; G09G 3/3275; G09G 3/3674; G09G 2300/0814; G09G 2300/0852; G09G 2300/0823; G09G 2310/04; G09G 2310/0254; G09G 2310/0205; G09G 2310/0275; G09G 2310/0283; G09G 2310/0291; G09G 2330/021; G09G 2320/0252; G09G 2320/103; G09G 2340/16; G09G 2360/12; G09G 2360/18; G02F 1/13624; G02F 1/136213; G02F 1/136286; G02F 1/1368
See application file for complete search history.

(56) References Cited

U.S. PATENT DOCUMENTS

| | | | | |
|---|---|---|---|---|
| 6,795,066 | B2 | 9/2004 | Tanaka et al. | |
| 7,321,353 | B2 | 1/2008 | Tsuda et al. | |
| 2002/0190940 | A1 | 12/2002 | Itoh et al. | |
| 2005/0285837 | A1 | 12/2005 | Akimoto | |
| 2007/0001963 | A1 | 1/2007 | Koma | |
| 2011/0090183 | A1 | 4/2011 | Yamazaki et al. | |
| 2011/0090204 | A1 | 4/2011 | Yamazaki et al. | |
| 2011/0134099 | A1* | 6/2011 | Tsubata | G02F 1/13624 345/211 |
| 2011/0148846 | A1 | 6/2011 | Arasawa et al. | |
| 2011/0149165 | A1* | 6/2011 | Tsuchiya | G09G 3/2011 348/624 |
| 2011/0149185 | A1 | 6/2011 | Yamazaki | |
| 2011/0199404 | A1* | 8/2011 | Umezaki | G09G 3/3648 345/691 |
| 2011/0285759 | A1* | 11/2011 | Sakai | G09G 3/3648 345/690 |
| 2014/0015819 | A1 | 1/2014 | Yamazaki et al. | |
| 2014/0015868 | A1 | 1/2014 | Yamazaki et al. | |
| 2014/0028645 | A1 | 1/2014 | Yamazaki et al. | |

FOREIGN PATENT DOCUMENTS

| | | |
|---|---|---|
| JP | 2011-145667 | 7/2011 |
| WO | WO-2010/106713 | 9/2010 |
| WO | WO-2011/046032 | 4/2011 |

* cited by examiner

LIQUID CRYSTAL DISPLAY DEVICE AND METHOD FOR DRIVING THE SAME

BACKGROUND OF THE INVENTION

1. Field of the Invention

The present invention relates to a liquid crystal display device and a method for driving the liquid crystal display device.

2. Description of the Related Art

In view of fossil fuel exhaustion, environmental problems, and the like, all kinds of electronic devices are required to consume less power. Liquid crystal display devices are no exception. For example, techniques of reducing the frequency of rewriting pixels in order to reduce power consumption of a liquid crystal display device have been reported (see the following references).

REFERENCES

Patent Documents

[Patent Document 1] U.S. Pat. No. 7,321,353
[Patent Document 2] Japanese Published Patent Application No. 2011-145667

Non-Patent Document

[Non-Patent Document 1] K. Tsuda et al., IDW'02, Proc., pp. 295-298

SUMMARY OF THE INVENTION

High display quality is required for liquid crystal display devices, and driving frequencies of liquid crystal display devices tend to be increased (e.g., to 120 Hz or 240 30 Hz, an integral multiple of 60 Hz) along with an increase in the number of pixels for higher definition and higher resolution. Therefore, techniques for reducing power consumption due to the increase in driving frequencies have been demanded.

Methods for driving liquid crystal display devices mainly employ inversion driving performed every frame period in order to prevent burn-in due to deterioration of a liquid crystal element. Examples of inversion driving include gate line inversion driving, source line inversion driving, frame inversion driving, and dot inversion driving.

However, in inversion driving in which the polarity of a data signal written into a pixel is changed every frame period, the amount of change in data signal voltage due to rewriting of a pixel is large even when the strength of an electric field which acts upon liquid crystal is unchanged; this leads to an increase in power consumption. This problem becomes more prominent with an increase in driving frequency or an increase in screen size.

In view of the above, an object of one embodiment of the present invention is to provide a liquid crystal display device which consumes less power and a method for driving the liquid crystal display device.

One embodiment of the present invention is a liquid crystal display device including a scan line to which a scan signal is input; a data line to which a data signal is input; a plurality of pixels each including a liquid crystal element which includes liquid crystal, a pixel electrode, and a common electrode and a switching element which controls electrical conduction between the pixel electrode and the data line in accordance with the scan signal; a display portion including the plurality of pixels; a scan line driver circuit which outputs the scan signal to the scan line; and a data line driver circuit which outputs the data signal to the data line. The liquid crystal display device includes a first control circuit which controls the scan line driver circuit and the data line driver circuit and a second control circuit which controls a polarity of the data signal input to the data line. The second control circuit generates a polarity control signal that maintains the polarity of the data signal for two or more frame periods. The data line driver circuit processes an image signal to generate the data signal having the polarity corresponding to the polarity control signal. The first control circuit performs or stops rewriting of the plurality of pixels in accordance with the image signal.

Another embodiment of the present invention is the above liquid crystal display device. The liquid crystal display device includes a first control circuit which controls the scan line driver circuit and the data line driver circuit and a second control circuit which controls a polarity of the data signal input to the data line. The second control circuit generates a polarity control signal that inverts the polarity of the data signal every m frame periods (m is an integer greater than or equal to 2). The data line driver circuit processes an image signal to generate the data signal having the polarity corresponding to the polarity control signal. The first control circuit performs or stops rewriting of the plurality of pixels in accordance with the image signal and performs, in response to a change in a potential level of the polarity control signal, rewriting of the plurality of pixels at least in one frame period in a period during which rewriting of the plurality of pixels is stopped.

Another embodiment of the present invention is a method for driving the above liquid crystal display device. The method includes the steps of outputting the data signal whose polarity is inverted every m frame periods (m is an integer greater than or equal to 2) to the data line and rewriting the plurality of pixels every m frame periods in a period during which an image without motion is displayed in the display portion.

According to the present invention, power consumption of a liquid crystal display device can be reduced.

BRIEF DESCRIPTION OF THE DRAWINGS

FIGS. 9A and 9B are plan views and FIG. 9C is a cross-sectional view.

FIG. 10A shows a TN mode or a VA mode, FIG. 10B shows an MVA mode, FIG. 10C shows an IPS mode, and FIG. 10D shows an FFS mode.

FIG. 11A shows a portable game machine, FIG. 11B shows a digital camera, FIG. 11C shows a television set, FIG. 11D shows a mobile phone, FIG. 11E shows electronic paper, and FIG. 11F shows a computer.

DETAILED DESCRIPTION OF THE INVENTION

Figure 1:
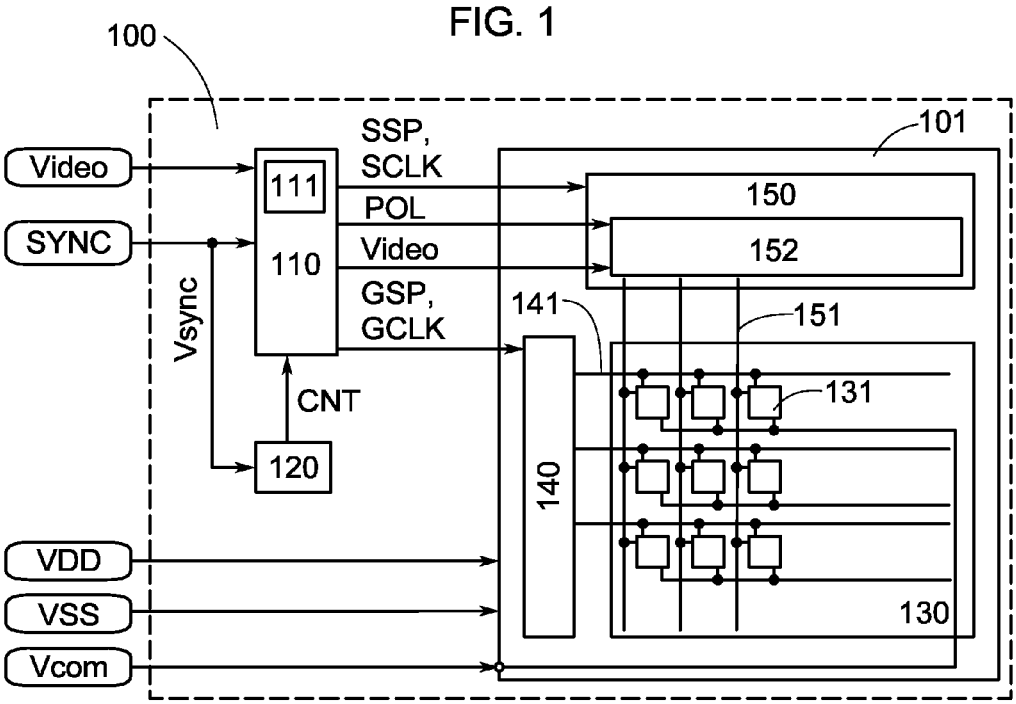
FIG. 1 is a block diagram showing a structural example of a liquid crystal display device.

Hereinafter, embodiments of the present invention will be described in detail with reference to the accompanying drawings. Note that the present invention is not limited to the description below, and it is easily understood by those skilled in the art that a variety of changes and modifications can be made without departing from the spirit and scope of the present invention. Accordingly, the present invention should not be construed as being limited to the description of the embodiments below.

Note that in the drawings used for the description of the embodiments of the invention, the same portions or portions having similar functions are denoted by the same reference numerals, and repeated description thereof is omitted.

Embodiment 1

Examples of a liquid crystal display device and a method for driving the liquid crystal display device are described with reference to FIG. 1, FIG. 2, FIG. 3, FIG. 4, FIG. 5, FIG. 6, FIG. 7, and FIGS. 8A and 8B.

FIG. 1 is a block diagram illustrating a structural example of a liquid crystal display device in this embodiment. As shown in FIG. 1, a liquid crystal display device 100 includes a liquid crystal panel 101, a control circuit 110, and a counter circuit 120.

An image signal (Video), which is digital data, and a synchronization signal (SYNC) for controlling rewriting of a screen of the liquid crystal panel 101 are input to the liquid crystal display device 100. Examples of a synchronization signal include a horizontal synchronization signal (Hsync), a vertical synchronization signal (Vsync), and a reference clock signal (CLK).

The liquid crystal panel 101 includes a display portion 130, a scan line driver circuit 140, and a data line driver circuit 150. The display portion 130 includes a plurality of pixels 131. The pixels 131 in the same row are connected to the scan line driver circuit 140 through a common scan line 141, and the pixels 131 in the same column are connected to the data line driver circuit 150 through a common data line 151.

A high power supply voltage (VDD) and a low power supply voltage (VSS), which serve as power supply voltages, and a common voltage (Vcom) are supplied to the liquid crystal panel 101. The common voltage (hereinafter referred to as Vcom) is supplied to each pixel 131 in the display portion 130.

The data line driver circuit 150 processes an input image signal to generate a data signal, and outputs the data signal to the data line 151. The scan line driver circuit 140 outputs, to the scan line 141, a scan signal for selecting the pixel 131 into which a data signal is to be written.

The pixel 131 includes a switching element whose electrical connection to the data line 151 is controlled by a scan signal. When the switching element is turned on, a data signal is written into the pixel 131 through the data line 151.

Figure 2:
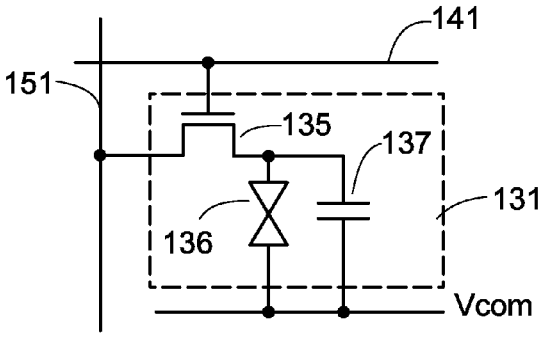
FIG. 2 is a circuit diagram showing a structural example of a pixel.

FIG. 2 is a circuit diagram showing a structural example of the pixel 131. The pixel 131 includes a transistor 135, a liquid crystal element 136, and a capacitor 137. The transistor 135 is a switching element which controls electrical conduction between the liquid crystal element 136 and the data line 151. The transistor 135 is turned on or off by a scan signal input through its gate.

The liquid crystal element 136 has a capacitor structure in which charge is accumulated, and includes two electrodes and liquid crystal. The alignment of the liquid crystal is changed by the action of an electric field between the two electrodes. Here, one of the two electrodes of the liquid crystal element 136, which is connected to the data line 151 via the transistor 135, is referred to as a pixel electrode, and the other, to which Vcom is applied, is referred to as a common electrode.

The capacitor 137 is connected in parallel to the liquid crystal element 136. One electrode of the capacitor 137 is part of the common electrode.

The counter circuit 120 counts the cycles of a vertical synchronization signal (hereinafter referred to as Vsync), which is one of synchronization signals. The counter circuit 120 resets its count value to the initial value when the count value reaches the final value, and starts counting from the initial value again.

The control circuit 110 controls the whole liquid crystal display device 100 and includes a circuit which generates control signals for circuits included in the liquid crystal display device 100.

The control circuit 110 includes a control circuit generation circuit which generates control signals for the scan line driver circuit 140 and the data line driver circuit 150 on the basis of the synchronization signal (SYNC). Examples of a control signal for the scan line driver circuit 140 include a start pulse (GSP) and a clock signal (GCLK). Examples of a control signal for the data line driver circuit 150 include a start pulse (SSP) and a clock signal (SCLK). For example, the control circuit 110 generates a plurality of clock signals with the same cycle and shifted phases as the clock signals (GCLK and SCLK).

Further, the control circuit 110 controls output of an image signal (Video), which is input from the outside of the liquid crystal display device 100, to the data line driver circuit 150.

The control circuit 110 also includes a polarity control circuit which generates a polarity control signal (hereinafter referred to as POL). The polarity control signal, whose potential level is either a high level (H level) or a low level (L level), controls the polarity of a data signal written into the pixel 131 (the data line 151). When the count value (CNT) output from the counter circuit 120 is reset, the control circuit 110 switches the potential level of the polarity control signal (POL) from high to low or from low to high.

Note that the polarity of a data signal input to the data line 151 is determined relative to Vcom. The polarity is positive when the voltage of the data signal is higher than Vcom, and is negative when the voltage of the data signal is lower than Vcom.

The data line driver circuit 150 includes a digital/analog conversion circuit 152 (hereinafter referred to as D-A conversion circuit 152). The D-A conversion circuit 152 converts an image signal to an analog signal, thereby generating a data signal. At this time, the D-A conversion circuit 152 converts the image signal to an analog signal such that the polarity of the data signal corresponds to the potential level of POL.

Note that in the case where an image signal input to the liquid crystal display device 100 is an analog signal, the image signal is converted to a digital signal in the control circuit 110 and output to the liquid crystal panel 101.

An image signal is image data for each frame. The control circuit 110 has a function of performing image processing on the image signal and controlling output of the image signal to the data line driver circuit 150 on the basis of data obtained by the processing. For that function, the control circuit 110 includes a motion detection portion 111 which performs image processing on the image signal to detect motion in the image data for each frame. The control circuit 110 stops output of an image signal to the data line driver circuit 150 when the motion detection portion 111 determines that there is no motion, and restarts the output of an image signal when the motion detection portion 111 determines that there is motion.

There is no particular limitation on the image processing for detecting motion which is performed in the motion detection portion 111. An example of a method for detecting motion is to obtain difference data from image data for two consecutive frames. It can be determined whether there is motion or not from the obtained difference data. Another example of the method is to detect a motion vector.

In addition, the liquid crystal display device 100 may be provided with an image signal correction circuit which corrects an input image signal. For example, an image signal is corrected such that a voltage higher than a voltage corresponding to the gray level of the image signal is written into the pixel 131. Such correction can shorten the response time of the liquid crystal element 136. A method in which the control circuit 110 is driven with an image signal corrected in this manner is referred to as overdriving. In the case of performing high frame rate driving in which the liquid crystal display device 100 is driven at an integral multiple of the frame frequency of an image signal, image data for interpolation between two frames or image data for performing black display between two frames may be generated in the control circuit 110.

Figure 3:
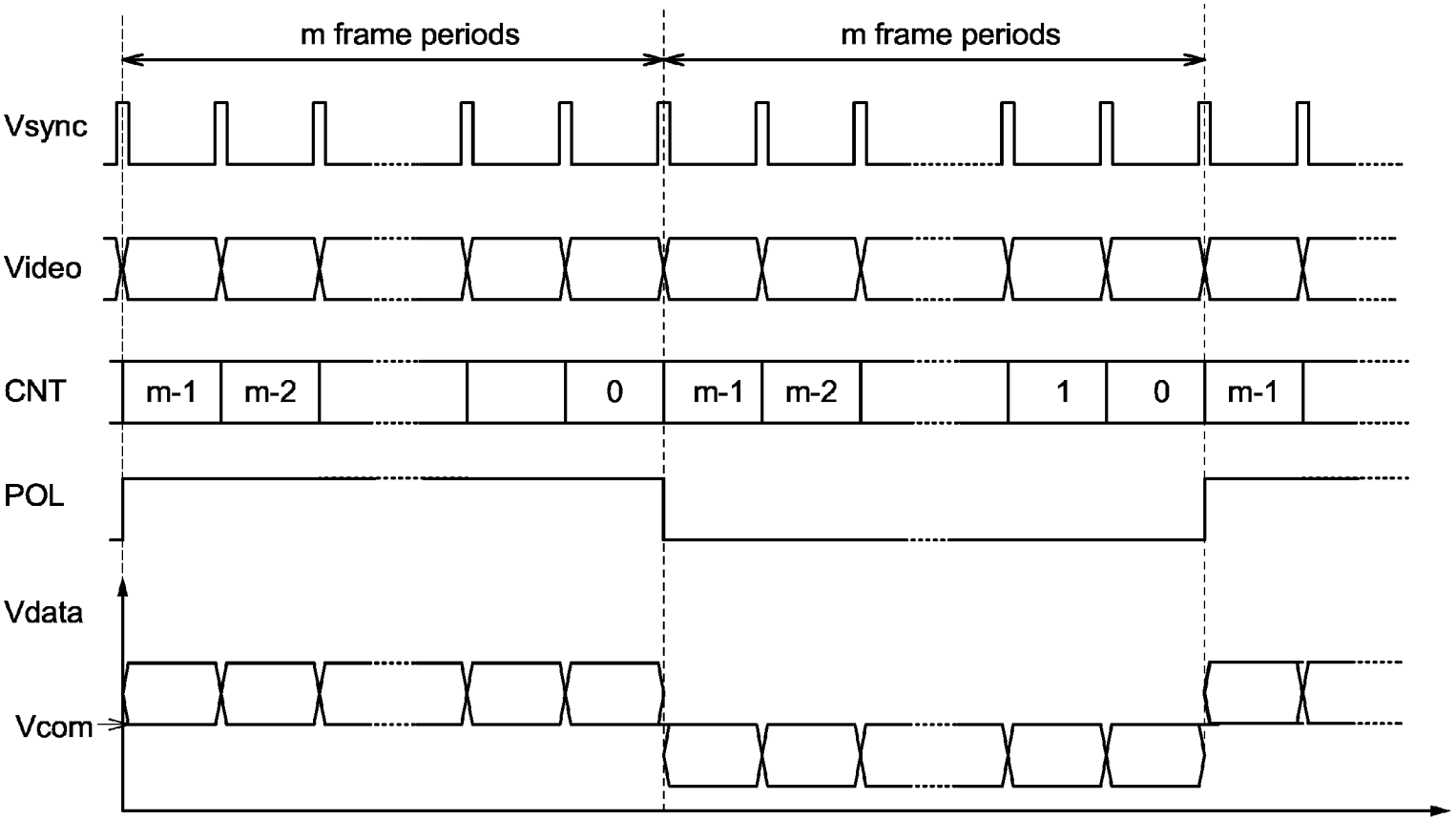
FIG. 3 is a timing chart showing an example of a method for driving a liquid crystal display device.
Figure 4:
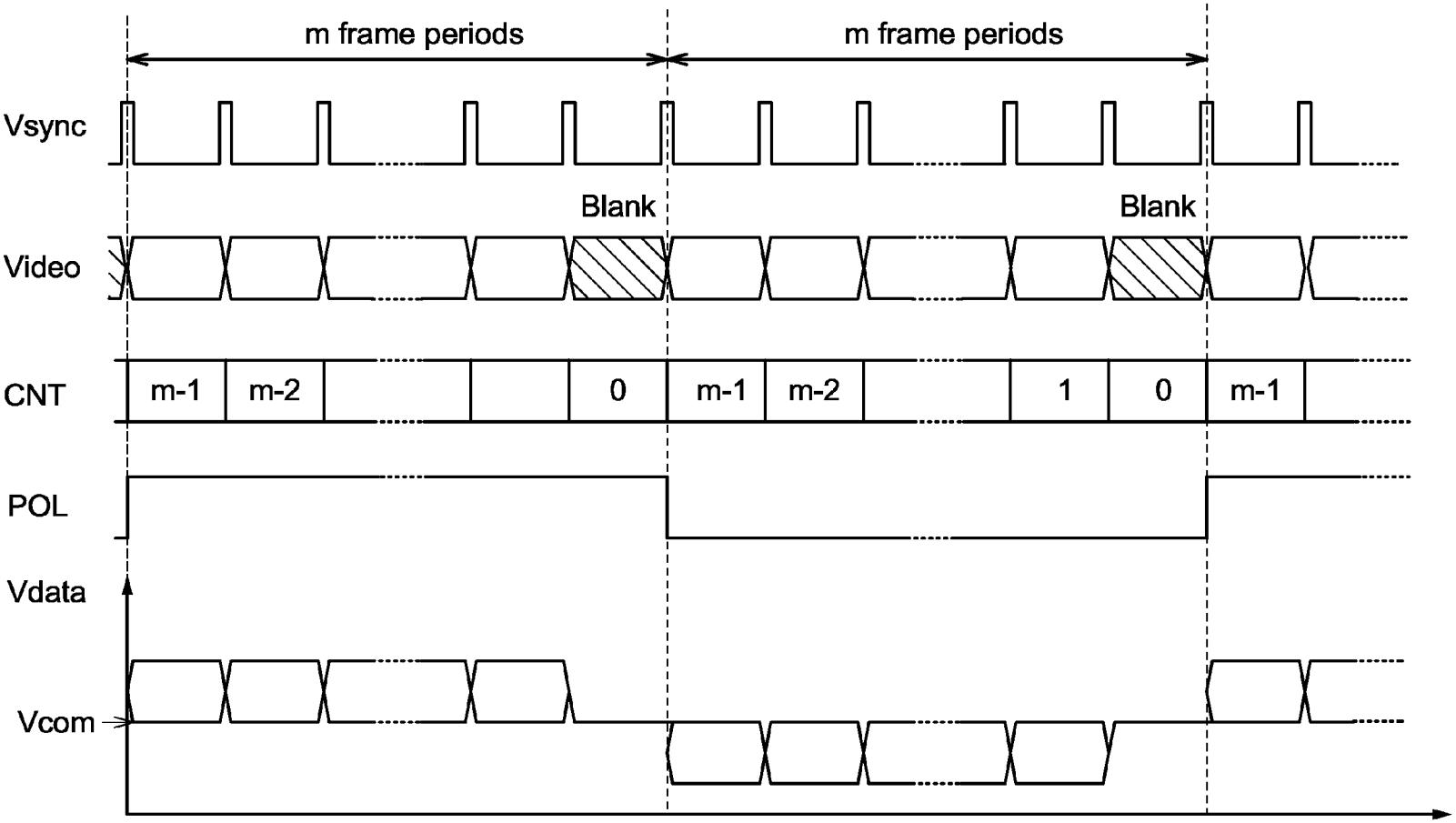
FIG. 4 is a timing chart showing an example of a method for driving a liquid crystal display device.
Figure 5:
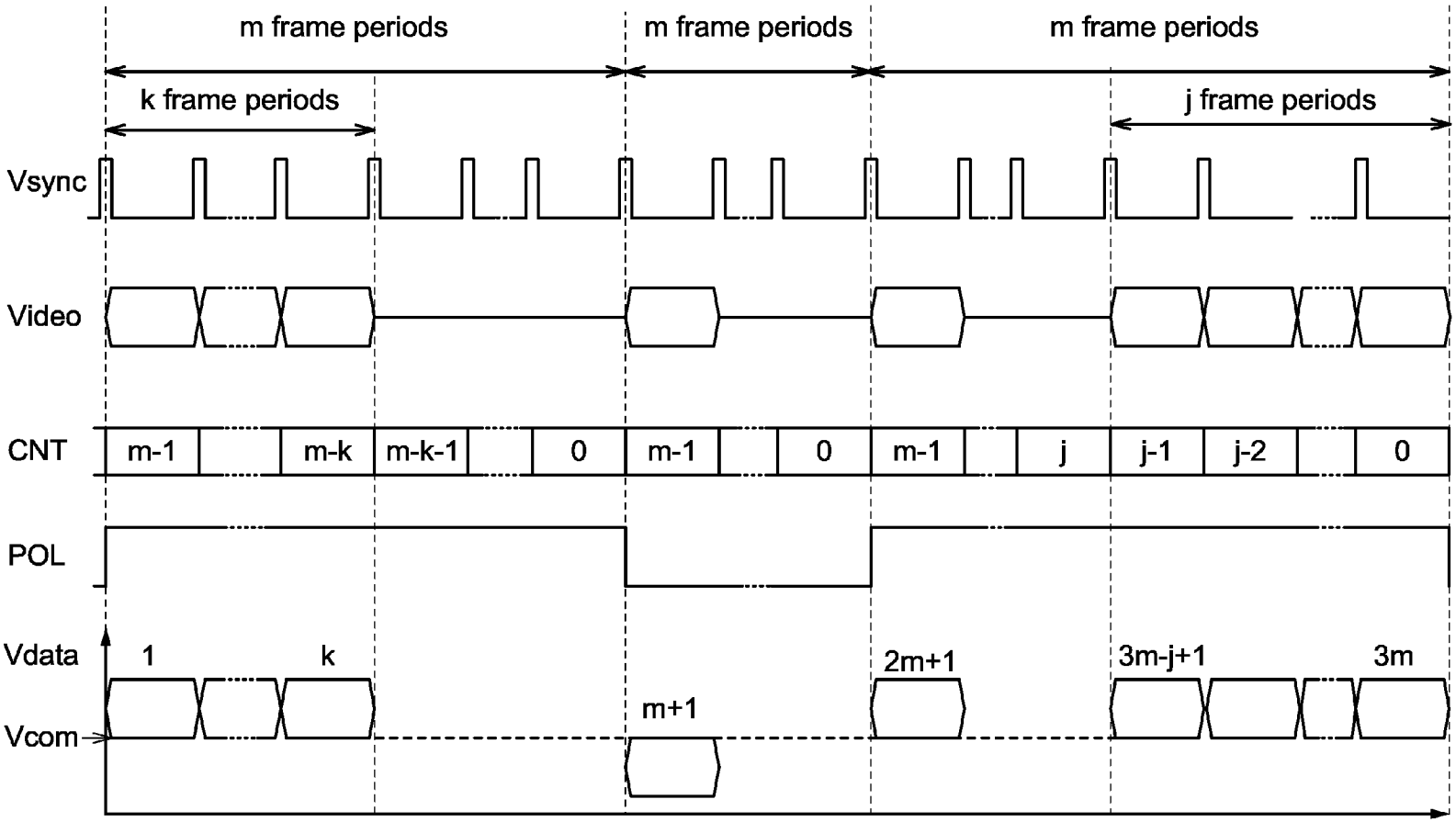
FIG. 5 is a timing chart showing an example of a method for driving a liquid crystal display device.

The operation of the liquid crystal display device 100 is described below with reference to flow charts in FIG. 3, FIG. 4, and FIG. 5. FIG. 3, FIG. 4, and FIG. 5 each show the signal waveforms of a vertical synchronization signal (Vsync), an image signal (Video) output to the data line driver circuit 150 from the control circuit 110, a count value (CNT) output to the control circuit 110 from the counter circuit 120, a polarity control signal (POL) output to the data line driver circuit 150 from the control circuit 110, and a data signal (Vdata) output to the data line 151 from the data line driver circuit 150.

First, a method for driving the liquid crystal panel 101 in displaying an image with motion, such as a moving image, is described with reference to FIG. 3.

The control circuit 110 outputs an image signal Video to the data line driver circuit 150 in synchronization with the rise of the vertical synchronization signal (hereinafter sometimes referred to as Vsync) to an H level. The counter circuit 120 counts the number of pulses of the vertical synchronization signal Vsync backward from the initial value to the final value. Here, the counter circuit 120 is a backward counter circuit. The counter circuit 120 starts counting from the initial value (m−1), and subtracts 1 from the count value (hereinafter referred to as CNT) every time H-level Vsync is input. CNT is reset to the initial value when it becomes zero.

In the polarity control circuit in the control circuit 110, the potential level of POL is switched when CNT becomes m−1. In FIG. 3, POL is an H-level signal in the first m frame periods; POL is an L-level signal in the next m frame periods. In other words, the potential level of POL is inverted every m frame periods in the control circuit 110.

The data line driver circuit 150 converts an image signal (Video) into an analog signal, thereby generating a data signal (Vdata). The polarity of the data signal (Vdata) is determined in accordance with the potential level of POL. In FIG. 3, the polarity of the data signal (Vdata) is positive when POL is an H-level signal and negative when POL is an L-level signal. In other words, the polarity of the data signal (Vdata) is inverted every m frame periods in response to a change in the potential level of POL.

In general liquid crystal display devices, inversion driving in which the direction of an electric field which acts upon a liquid crystal element is inverted every frame period is performed in order to prevent burn-in of a display portion. Accordingly, the larger the magnitude of data signal voltage is, the larger the amount of change in data signal voltage between two frame periods is; this leads to an increase in power consumption. Such increase in power consumption becomes more prominent with an increase in the frequency of a vertical synchronization signal.

In the liquid crystal display device 100, data signals (Vdata) with the same polarity can be written into the pixel 131 for two or more consecutive frame periods. Therefore, polarity inversion of a data signal (Vdata) is performed less frequently as compared with the case of performing inversion driving every frame period, and thus the amount of change in data signal (Vdata) voltage between two consecutive frames is small, which leads to lower power consumption.

However, in the driving method in FIG. 3, the amount of change in data signal (Vdata) voltage between two frames where the potential level of POL is switched is similar to that in the inversion driving performed every frame period. In the case of performing inversion driving every m frame periods, the amount of change in data signal (Vdata) voltage between two frames where the potential level of POL is switched means the amount of change in data signal (Vdata) voltage between the m-th frame and the (m+1)-th frame and between the 2m-th frame and the (2m+1)-th frame.

As a driving method for further reducing the amount of change in data signal (Vdata) voltage, a driving method in which the voltage of a data signal (Vdata) is set equal to Vcom before data signals (Vdata) with an inverted polarity are written into the data line 151 is preferable. For example, as shown in FIG. 4, Vcom is written into the data line 151 in a frame period right before the switching of the potential level of POL.

Specifically, the control circuit 110 outputs, to the data line driver circuit 150, an image signal (Blank) such that the voltage of a data signal (Vdata) becomes equal to Vcom when CNT reaches the final value (zero). The data line driver circuit 150 converts the image signal (Blank) to an analog signal, thereby outputting Vcom as the data signal (Vdata) to the data line 151. Consequently, Vcom is written into the pixel 131 in the m-th frame period and in the 2m-th frame period.

Note that Vcom may be written into the data line 151 in the first frame period after the switching of the potential level of POL. Further, Vcom may be written into the data line 151 for two or more frame periods.

As described above, Vcom is applied to the data line 151 in response to the switching of the potential level of POL, whereby the amount of change in data signal voltage between two frames where the potential level of POL is switched can be reduced as compared with the driving method in FIG. 3, which leads to a further reduction in the power consumption of the liquid crystal display device 100.

Next, the operation of the liquid crystal display device 100 for displaying an image with motion, such as a moving image, and an image without motion, such as a still image, is described with reference to FIG. 5. The liquid crystal display device 100 can switch its operation between a moving image display mode and a still image display mode.

FIG. 5 is a timing chart of the liquid crystal display device 100 during 3m frame periods. Here, there is motion in image data in the first k frame periods and the last j frame periods and there is no motion in image data in the other frame periods. Note that k and j are each an integer greater than or equal to 1 and less than or equal to m−2.

In the first k frame periods, the motion detection portion 111 determines that there is motion in image data for each frame. The control circuit 110 outputs data signals (Vdata) to the data line 151, as in FIG. 3, on the basis of the result of determination by the motion detection portion 111.

The motion detection portion 111 performs image processing for detecting motion and determines that there is no motion in image data for the (k+1)-th frame. Then, the control circuit 110 stops output of image signals (Video) to the data line driver circuit 150 in the (k+1)-th frame period on the basis of the result of determination by the motion detection portion 111. Further, the control circuit 110 stops output of control signals (e.g., a start pulse signal and a clock signal) to the scan line driver circuit 140 and the data line driver circuit 150 in order to stop rewriting of the display portion 130. The control circuit 110 does not output an image signal (Video) to the data line driver circuit 150 nor output control signals to the scan line driver circuit 140 and the data line driver circuit 150, thereby keeping rewriting of the display portion 130 stopped, until the motion detection portion 111 determines that there is motion in image data.

Note that, in this specification, "to stop output of a signal" or "not to output a signal" means to apply voltage which is different from a predetermined voltage for operating a circuit to a wiring for supplying the signal, or to bring the wiring into an electrically floating state.

When rewriting of the display portion 130 is stopped, an electric field in one direction is kept applied to the liquid crystal element 136, which might lead to deterioration of liquid crystal in the liquid crystal element 136. In the case where such a problem is likely to occur, it is preferable that signals be supplied to the scan line driver circuit 140 and the data line driver circuit 150 from the control circuit 110 and data signals (Vdata) with an inverted polarity be written into the data line 151 at predetermined timings to invert the direction of the electric field applied to the liquid crystal element 136, regardless of the result of determination by the motion detection portion 111.

An example of such a driving method is a method in which the control circuit 110 outputs an image signal (Video) and outputs control signals for the scan line driver circuit 140 and the data line driver circuit 150 in response to the switching of the potential level of POL, so that the display portion 130 is rewritten at least in one frame period. This driving method is described below with reference to FIG. 5.

As shown in FIG. 5, when CNT reaches the initial value (m−1), the control circuit 110 outputs control signals to the scan line driver circuit 140 and the data line driver circuit 150 and outputs an image signal (Video) to the data line driver circuit 150. The data line driver circuit 150 outputs a data signal (Vdata) with a polarity corresponding to the potential level of POL to the data line 151. In this manner, a data signal (Vdata) with an inverted polarity is written into the data line 151 in the (m+1)-th frame period and in the (2m+1)-th frame period, which are periods in which no motion is detected in image data. Rewriting of the display portion 130 is intermittently performed in periods in which there is no change in image data; thus, it is possible to reduce power consumption due to rewriting and prevent deterioration of the liquid crystal element 136.

When the motion detection portion 111 determines that there is motion in image data for any frame after the (2m+1)-th frame, the control circuit 110 controls the scan line driver circuit 140 and the data line driver circuit 150 to perform rewriting of the display portion 130, as in FIG. 3.

As described above, with the driving method in FIG. 5, the polarity of a data signal is inverted every m frame periods regardless of whether there is motion in image data or not. Meanwhile, the display portion 130 is rewritten every frame in periods in which an image with motion is displayed and is rewritten every m frames in periods in which an image without motion is displayed. Consequently, power consumed owing to inversion driving and rewriting of the display portion can be reduced. This can prevent an increase in power consumption due to an increase in driving frequency and the number of pixels.

As described above, the method for driving the liquid crystal display device is switched between in a moving image display mode and in a still image display mode; thus, it is possible to provide a liquid crystal display device with low power consumption while preventing deterioration of liquid crystal and maintaining display quality.

Note that, in order to prevent deterioration of the liquid crystal, the interval between polarity inversions of data signals (here, m frame periods) is set to two seconds or shorter, preferably one second or shorter.

Further, in the driving method in FIG. 5, Vcom can be written into the data line 151, as in the driving method in FIG. 4, before a data signal with an inverted polarity is written into the data line 151. In this case, Vcom may be written into the data line 151 only in periods in which image data with motion is displayed, as in FIG. 4, or may be written in response to the switching of the potential level of POL regardless of whether there is motion in image data or not.

Although the detection of motion in image data is performed in the motion detection portion 111 in the control circuit 110, the detection of motion is not necessarily performed only in the motion detection portion 111. Data on whether there is motion or not may be input to the control circuit 110 from the outside of the liquid crystal display device 100.

Determination that there is no motion in image data is not always based on image data for two consecutive frames; the number of frames required for the determination may be set as appropriate depending on the usage mode of the liquid crystal display device 100. For example, rewriting of the display portion 130 may be stopped when there is no motion in image data for m consecutive frames.

Figure 6:
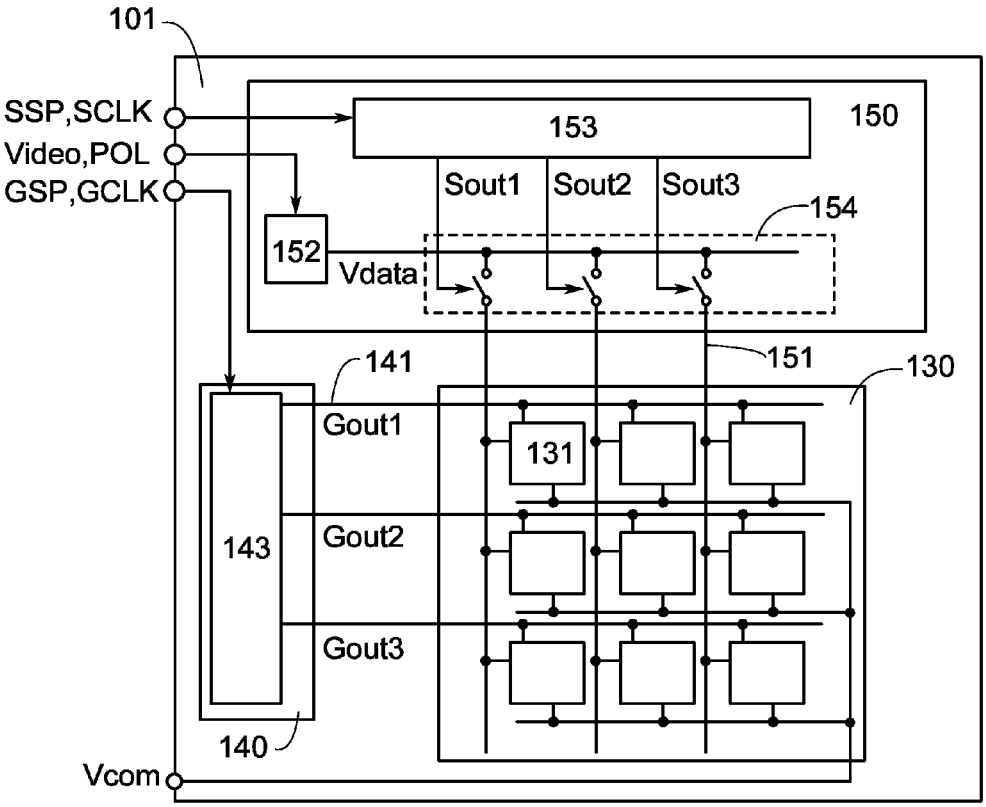
FIG. 6 is a block diagram showing a structural example of a driver circuit of a liquid crystal display device.

Next, a structural example and a driving method of the scan line driver circuit 140 and the data line driver circuit 150 are described with reference to FIG. 6. FIG. 6 is a block diagram of the liquid crystal panel 101. Note that FIG. 6 shows an example in which the display portion 130 includes the pixels 131 in a matrix of three rows and three columns for convenience of description.

The scan line driver circuit 140 includes a shift register circuit 143. Control signals (the start pulse GSP and the clock signal GCLK) are input to the shift register circuit 143. The shift register circuit 143 outputs scan signals Gout1 to Gout3 to the scan lines 141 in the first to third rows in response to the control signals.

The data line driver circuit 150 includes the D-A conversion circuit 152, a shift register circuit 153, and an analog switch circuit 154. The D-A conversion circuit 152 converts an input image signal (Video) to an analog signal, thereby generating a data signal (Vdata), and outputs the data signal to the analog switch circuit 154.

Control signals (the start pulse SSP and the clock signal SCLK) are input to the shift register circuit 153. The shift register circuit 153 outputs selection signals Sout1 to Sout3 to the analog switch circuit 154. The analog switch circuit 154 is provided with switching elements which control electrical connection of the respective data lines 151 to the D-A conversion circuit 152. The switching elements are controlled to be on or off by the selection signals Sout1 to Sout3, which are output from the shift register circuit 153.

Figure 7:
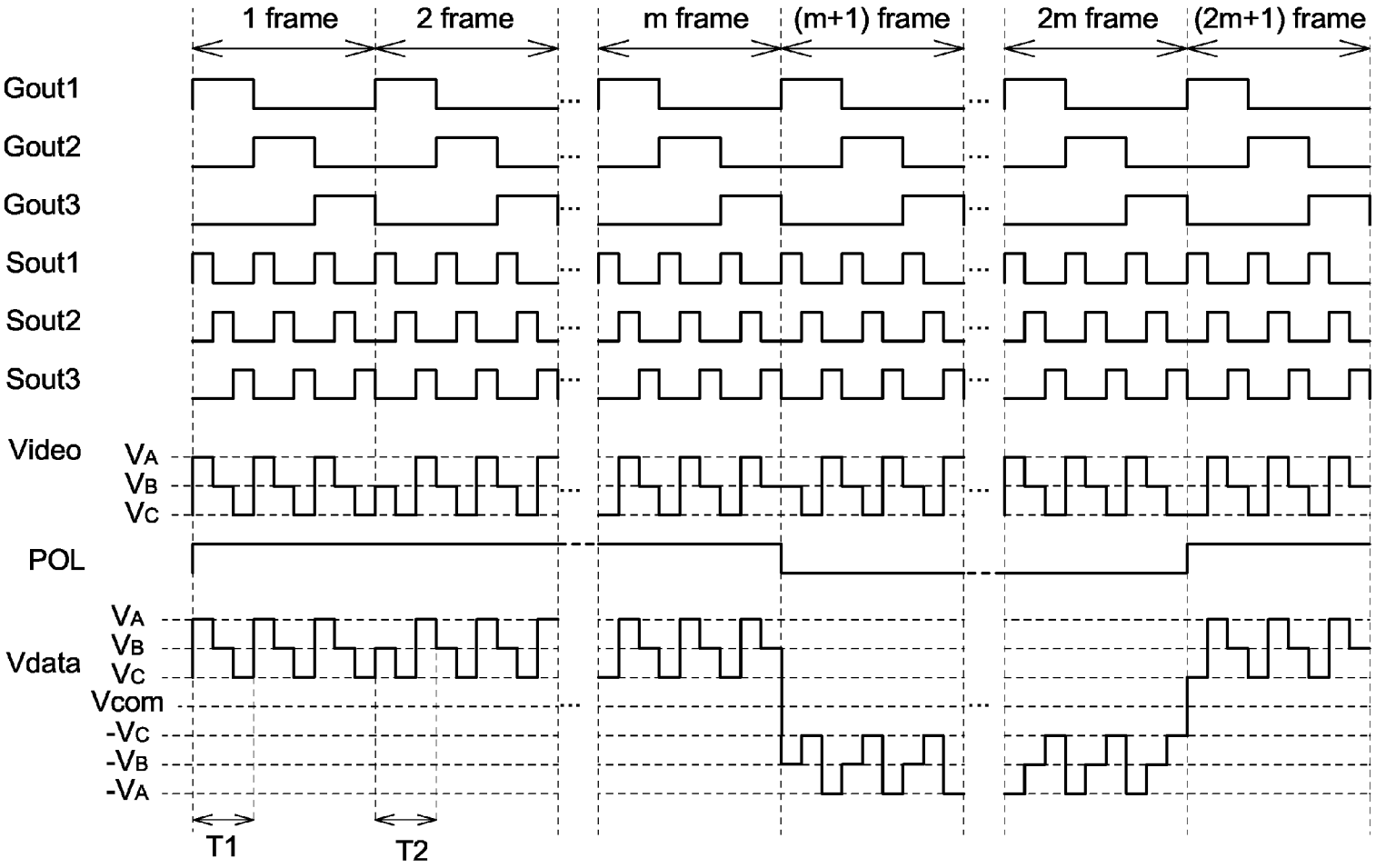
FIG. 7 is a timing chart showing an example of operation of the driver circuit in FIG. 6.

The operation of the scan line driver circuit 140 and the data line driver circuit 150 is described below with reference to FIG. 7. FIG. 7 is a timing chart of the liquid crystal panel 101 in FIG. 6. FIG. 7 shows the signal waveforms of a polarity control signal (POL) and image signals (Video) which are input to the D-A conversion circuit 152, scan signals (Gout1 to Gout3) output from the shift register circuit 143, selection signals (Sout1 to Sout3) output from the shift register circuit 153, and data signals (Vdata) output from the D-A conversion circuit 152. FIG. 7 shows the signal waveforms for dot sequential driving.

To simplify the description, it is assumed that signals corresponding to three gray levels are generated as data signals in the D-A conversion circuit 152. The voltages of the data signals are expressed as $V_A$, $V_B$, and $V_C$ in the case of positive data signals and expressed as $-V_A$, $-V_B$, and $-V_C$ in the case of negative data signals. The magnitudes of the voltages satisfy $|V_C|<|V_B|<|V_A|$.

The transistor 135 of each pixel 131 is turned on when the scan signals Gout1 to Gout3 are H-level signals, and each switching element of the analog switch circuit 154 is turned on when the selection signals Sout1 to Sout3 are H-level signals.

As shown in FIG. 7, the potentials of the scan lines 141 rise to a high level row by row by input of the scan signals Gout1 to Gout3. The selection signals Sout1 to Sout3 sequentially rise to an H level in a period during which the potential of the scan line 141 in one row is at the high level (H level), and data signals are written into the pixels 131 in that row column by column.

As described with reference to FIG. 3 and the like, the polarity of a data signal to be input to the pixel 131 is inverted every m frame periods; thus, power consumed owing to inversion driving can be reduced. The reason is described below with reference to FIGS. 8A to 8B.

Figure 8A:
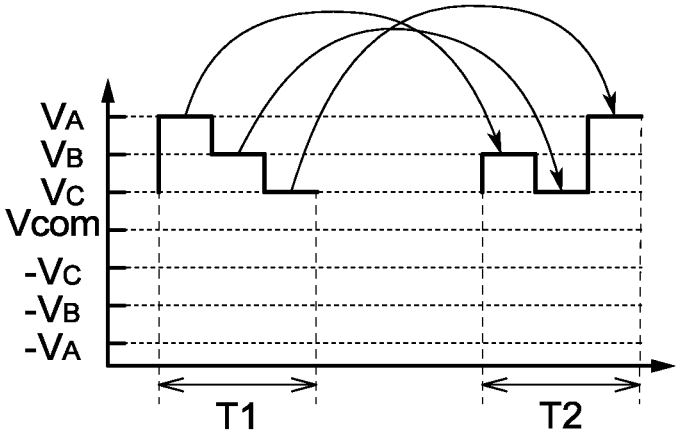
FIG. 8A shows the waveforms of data signals extracted from FIG. 7.
Figure 8B:
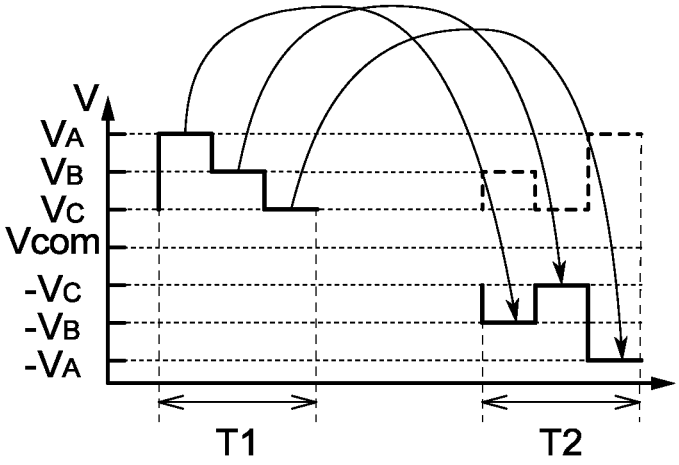
FIG. 8B shows the waveforms of data signals as a comparative example.

FIG. 8A is part of the timing chart in FIG. 7, which shows the waveforms of data signals in a period T1 and a period T2. FIG. 8B is a comparative example, which shows the waveforms of data signals in the case of performing polarity inversion of a data signal every frame. The period T1 and the period T2 correspond to the first frame period and the second frame period, respectively.

The arrows in each of FIGS. 8A and 8B indicate a change in voltage of the data signals written into the data line 151 in the same column. The amount of change in data signal voltage between the first frame period and the second frame period is $|V_A-V_B|$ in the first column, $|V_B-V_C|$ in the second column, and $|V_C-V_A|$ in the third column in FIG. 8A, and is $|V_A+V_B|$ in the first column, $|V_B+V_C|$ in the second column, and $|V_C+V_A|$ in the third column in FIG. 8B.

The amount of change in data signal voltage in the same column is larger in the inversion driving in FIG. 8B, in which the polarity of a data signal is inverted every frame, as compared with FIG. 8A. The amount of change in data signal voltage in the same column is reduced by performing polarity inversion of a data signal every m frame periods as in FIG. 8A. This indicates that it is possible to reduce power which is consumed by charge and discharge of a liquid crystal element in rewriting a pixel by setting the interval between polarity inversions of data signals to two or more frame periods.

Moreover, in displaying an image without motion, such as a still image, rewriting of a pixel is temporarily stopped, which leads to a further reduction in power consumption. Note that although dot sequential driving is described as an example here, a similar effect can be obtained also in line sequential driving.

This embodiment can be implemented in appropriate combination with any of the other embodiments.

Embodiment 2

In this embodiment, a structure of the liquid crystal panel 101 is described with reference to FIGS. 9A to 9C.

Figure 9B:
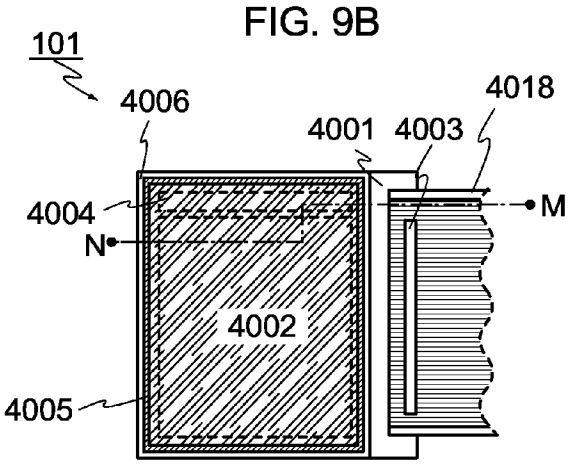
FIGS. 9A to 9C show structural examples of the liquid crystal panel in FIG. 1.
Figure 9A:
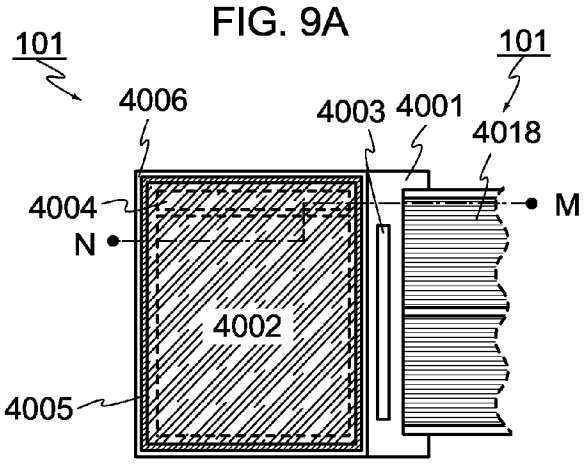
Figure 9C:
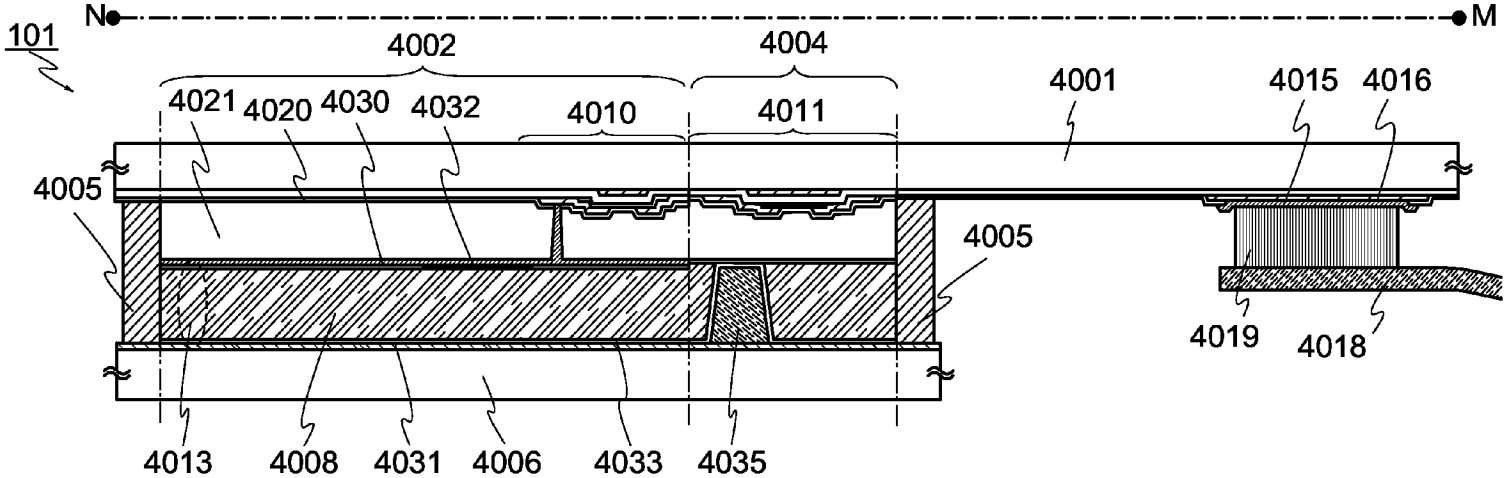

FIGS. 9A and 9B are plan views of the liquid crystal panel 101. FIG. 9C is a cross-sectional view showing a structural example of the liquid crystal panel 101, and corresponds to a cross section along line M-N in FIGS. 9A and 9B.

The liquid crystal panel 101 has a structure in which a liquid crystal layer 4008 is sealed between a substrate 4001 and a substrate 4006 with a sealant 4005.

A light-transmitting substrate can be used as each of the substrates 4001 and 4006. For example, a substrate made of glass, ceramics, plastics, or the like can be used. Examples of plastic substrates include a fiberglass-reinforced plastics (FRP) substrate, a polyvinyl fluoride (PVF) film, a polyester film, and an acrylic resin film.

A display portion 4002 including a plurality of pixels and a scan line driver circuit 4004 are provided in a region surrounded by the sealant 4005 over the substrate 4001. A data line driver circuit 4003 that is formed using a single crystal semiconductor layer or a polycrystalline semiconductor layer is mounted in a region outside the sealant 4005 over the substrate 4001. Examples of a method for mounting the data line driver circuit 4003 include a COG method, a wire bonding method, and a TAB method. The data line driver circuit 4003 is mounted by a COG method in FIG. 9A and is mounted by a TAB method in FIG. 9B.

The data line driver circuit 4003 may be provided over the substrate 4001. The scan line driver circuit 4004 may be formed over a substrate different from that of the display portion 4002 and then mounted on the substrate 4001. Alternatively, part of the data line driver circuit 4003 or part of the scan line driver circuit 4004 may be formed over a substrate different from that of the display portion 4002 and then mounted on the substrate 4001.

A pixel electrode 4030 included in a liquid crystal element 4013 is connected to a transistor 4010. A common electrode 4031 included in the liquid crystal element 4013 is formed on the substrate 4006. A portion where the pixel electrode 4030, the common electrode 4031, and the liquid crystal layer 4008 overlap with one another corresponds to the liquid crystal element 4013. Note that the structure of the liquid crystal element 4013 is changed as appropriate depending on a display mode of the liquid crystal panel 101. FIG. 9C shows the liquid crystal panel 101 in a TN mode as an example.

The pixel electrode 4030 and the common electrode 4031 are each formed using a layer including a light-transmitting conductive material such as indium oxide containing tungsten oxide, indium zinc oxide containing tungsten oxide, indium oxide containing titanium oxide, indium tin oxide containing titanium oxide, indium tin oxide, indium zinc oxide, or indium tin oxide to which silicon oxide is added.

The pixel electrode 4030 and the common electrode 4031 are provided with an insulating layer 4032 and an insulating layer 4033 which function as alignment films, respectively. Further, the liquid crystal panel 101 is provided with a polarizing plate, a light-blocking film functioning as a black matrix, or the like as appropriate.

An insulator 4035 is a spacer for maintaining the distance (cell gap) between the pixel electrode 4030 and the common electrode 4031. A spherical spacer can be used instead of the insulator 4035.

The display portion 4002 and the scan line driver circuit 4004 include a plurality of transistors. FIG. 9C illustrates the transistor 4010 for a pixel in the display portion 4002 and a transistor 4011 in the scan line driver circuit 4004 as representatives.

The transistors 4010 and 4011 each include a gate insulating layer, a gate electrode, and a wiring (e.g., a source wiring layer or a capacitor wiring layer), in addition to the semiconductor layer. An insulating layer 4020 is formed over the transistors 4010 and 4011. An insulating layer 4021 is formed over the insulating layer 4020, and the pixel electrode 4030 is formed over the insulating layer 4021.

As the insulating layer 4020, a silicon nitride film is formed by RF sputtering, for example. For the insulating layer 4021, an organic material having heat resistance, such as polyimide, acrylic, a benzocyclobutene-based resin, polyamide, or epoxy, can be used. Other than such organic materials, it is also possible to use a low-dielectric constant material (a low-k material), a siloxane-based resin, phosphosilicate glass (PSG), borophosphosilicate glass (BPSG), or the like. Note that the insulating layer 4021 may be formed by stacking a plurality of insulating films formed of these materials.

An electrode 4015 and an electrode 4016 which are formed outside the sealant 4005 over the substrate 4001 are terminals for connecting an FPC 4018 to the scan line driver circuit 4004 and the display portion 4002. The electrode 4015 is formed using the same conductive film as the pixel electrode 4030, and the electrode 4016 is formed using the same conductive film as source and drain electrode layers of the transistors 4010 and 4011. The electrode 4015 is electrically connected to a terminal included in the FPC 4018 via an anisotropic conductive film 4019.

Various control signals and power supply voltage are supplied to the data line driver circuit 4003, the scan line driver circuit 4004, and the display portion 4002 from the FPC 4018.

A wiring and a common contact portion for supplying common voltage to the common electrode 4031 are formed over the substrate 4001. The common contact portion is provided outside the display portion 4002, for example, in a region overlapping with the sealant 4005. The common electrode 4031 is connected to the common contact portion with conductive particles.

A semiconductor layer which includes a channel formation region of each of the transistors 4010 and 4011 is selected from an amorphous semiconductor layer, a microcrystalline semiconductor layer, a polycrystalline semiconductor layer, and a single crystal semiconductor layer. For example, a semiconductor layer including a Group 14 element such as silicon or germanium or an oxide semiconductor layer can be used. Here, the transistors 4010 and 4011 are n-channel transistors. In particular, the transistor 4010 serving as a switching element of a pixel is preferably manufactured using an oxide semiconductor layer for the following reason. Off-state current of a transistor can be significantly reduced by manufacturing the transistor using an oxide semiconductor layer; thus, fluctuations in voltage of a data signal which has been written into a pixel can be reduced, which leads to an improvement in display quality of a liquid crystal display device.

An oxide semiconductor layer in which impurities such as moisture or hydrogen serving as an electron donor (donor) are reduced and oxygen defects are reduced is an intrinsic (i-type) semiconductor or a substantially i-type semiconductor. Here, such an oxide semiconductor layer is referred to as a purified oxide semiconductor layer. A transistor manufactured using the purified oxide semiconductor layer has an extremely low off-state current and high reliability.

Various experiments can prove the extremely low off-state current of a transistor having a channel formation region in a purified oxide semiconductor layer. For example, the following measurement data was obtained: a transistor with a channel width of $1\times10^6$ μm and a channel length of 10 μm has off-state current lower than or equal to the measurement limit of a semiconductor parameter analyzer, that is, lower than or equal to $1\times10^{-13}$ A when the voltage (drain voltage) between a source and a drain ranges between 1 V and 10 V. In this case, off-state current standardized on the channel width of the transistor is lower than or equal to 100 zA/μm.

As another experiment, off-state current is measured using a circuit in which a transistor is connected to a capacitor and charge that is injected into or discharged from the capacitor is controlled by the transistor. In this case, the off-state current of the transistor is measured from a change in the amount of charge of the capacitor per unit time. As a result, it was confirmed that the off-state current of the transistor was several tens of yoctoamperes per micrometer (yA/μm) under a drain voltage of 3 V. This indicates that the transistor in which a channel formation region is formed using a purified oxide semiconductor layer has much lower off-state current than a transistor including crystalline silicon.

An oxide semiconductor preferably contains at least indium (In) or zinc (Zn). In addition, the oxide semiconductor preferably contains gallium (Ga) as a stabilizer for reducing variations in electrical characteristics among transistors. Elements serving as a stabilizer include, in addition to gallium, tin (Sn), hafnium (Hf), aluminum (Al), zirconium (Zr), and lanthanoids (lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu)).

As the oxide semiconductor, any of the following oxides can be used, for example: indium oxide, gallium oxide, tin oxide, zinc oxide, an In—Zn-based oxide, a Sn—Zn-based oxide, an Al—Zn-based oxide, a Zn—Mg-based oxide, a Sn—Mg-based oxide, an In—Mg-based oxide, an In—Ga-based oxide, an In—Ga—Zn-based oxide (also referred to as IGZO), an In—Al—Zn-based oxide, an In'Sn—Zn-based oxide, a Sn—Ga—Zn-based oxide, an Al—Ga—Zn-based oxide, a Sn—Al—Zn-based oxide, an In—Hf—Zn-based oxide, an In—La—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, and an In—Hf—Al—Zn-based oxide.

Here, an In—Ga—Zn-based oxide means an oxide containing In, Ga, and Zn, and there is no limitation on the atomic ratio of In, Ga, and Zn. Further, the In—Ga—Zn-based oxide may contain a metal element other than In, Ga, and Zn. The same applies to other oxide semiconductors.

In—Ga—Zn-based oxides, In—Sn—Zn-based oxides, and the like among oxide semiconductors are materials suitable for mass production, unlike silicon carbide, gallium nitride, and gallium oxide, because transistors with excellent electrical characteristics can be manufactured using films formed by sputtering or a wet process. Further, with the use of In—Ga—Zn-based oxides, transistors with excellent electrical characteristics can be formed over a glass substrate, which allows use of larger substrates.

Examples of an In—Ga—Zn-based oxide used for manufacture of a transistor include oxides with an atomic ratio of In:Ga:Zn=1:1:1 (=⅓:⅓:⅓) or In:Ga:Zn=2:2:1 (=⅖:⅖:⅕) and oxides with an atomic ratio close to these atomic ratios.

Examples of an In—Sn—Zn-based oxide include oxides with an atomic ratio of In:Sn:Zn=1:1:1 (=⅓:⅓:⅓), In:Sn:Zn=2:1:3 (=⅓:⅙:½), or In:Sn:Zn=2:1:5 (=¼:⅛:⅝) and oxides with an atomic ratio close to these atomic ratios.

Typical crystal structures of an oxide semiconductor layer used for a transistor are a single crystal structure, a polycrystalline (also referred to as polycrystal) structure, and an amorphous structure. As the oxide semiconductor layer, an oxide semiconductor layer having a characteristic crystal structure which is called a c-axis aligned crystalline oxide semiconductor (CAAC-OS) layer is particularly preferable. One of characteristics of a transistor including the CAAC-OS layer is that a change in electrical characteristics due to irradiation with visible light or ultraviolet light is small.

Note that a film which forms the oxide semiconductor layer may be a stacked film including two or more films of an amorphous oxide semiconductor film, a microcrystalline oxide semiconductor film, and a CAAC-OS film, for example.

The CAAC-OS film is one of oxide semiconductor films including a plurality of crystal parts, and most of the crystal parts each fit inside a cube whose one side is less than 100 nm. Thus, there is a case where a crystal part included in the CAAC-OS film fits inside a cube whose one side is less than 10 nm, less than 5 nm, or less than 3 nm. The density of defect states of the CAAC-OS film is lower than that of the microcrystalline oxide semiconductor film. The CAAC-OS film is described in detail below.

In a transmission electron microscope (TEM) image of the CAAC-OS film, a boundary between crystal parts, that is, a grain boundary is not clearly observed. Thus, in the CAAC-OS film, a reduction in electron mobility due to the grain boundary is less likely to occur.

According to the TEM image of the CAAC-OS film observed in a direction substantially parallel to a sample surface (cross-sectional TEM image), metal atoms are arranged in a layered manner in the crystal parts. Each metal atom layer has a morphology reflected by a surface over which the CAAC-OS film is formed (hereinafter a surface over which the CAAC-OS film is formed is referred to as a formation surface) or a top surface of the CAAC-OS film, and is arranged in parallel to the formation surface or the top surface of the CAAC-OS film.

On the other hand, according to the TEM image of the CAAC-OS film observed in a direction substantially perpendicular to the sample surface (plan TEM image), metal atoms are arranged in a triangular or hexagonal configuration in the crystal parts. However, there is no regularity of arrangement of metal atoms between different crystal parts.

Note that, in describing the crystal structure of a CAAC-OS film, the term "perpendicular" indicates that the angle formed between two straight lines is greater than or equal to 80° and less than or equal to 100°, and accordingly includes the case where the angle is greater than or equal to 85° and less than or equal to 95°. In addition, the term "parallel" indicates that the angle formed between two straight lines is greater than or equal to −10° and less than or equal to 10°, and accordingly includes the case where the angle is greater than or equal to −5° and less than or equal to 5°.

From the results of the cross-sectional TEM image and the plan TEM image, alignment is found in the crystal parts in the CAAC-OS film.

A CAAC-OS film is subjected to structural analysis with an X-ray diffraction (XRD) apparatus. For example, when a CAAC-OS film including an $InGaZnO_4$ crystal is analyzed by an out-of-plane method, a peak appears frequently when the diffraction angle (2θ) is around 31°. This peak is derived from the (009) plane of the $InGaZnO_4$ crystal, which indicates that crystals in the CAAC-OS film have c-axis alignment, and that the c-axes are aligned in a direction substantially perpendicular to the formation surface or the top surface of the CAAC-OS film.

On the other hand, when the CAAC-OS film is analyzed by an in-plane method in which an X-ray enters a sample in a direction substantially perpendicular to the c-axis, a peak appears frequently when 2θ is around 56°. This peak is derived from the (110) plane of the $InGaZnO_4$ crystal. Here, analysis (φ scan) is performed under conditions where the sample is rotated around a normal vector of a sample surface as an axis (φ axis) with 2θ fixed at around 56°. In the case where the sample is a single-crystal oxide semiconductor film of $InGaZnO_4$, six peaks appear. The six peaks are derived from crystal planes equivalent to the (110) plane. On the other hand, in the case of a CAAC-OS film, a peak is not clearly observed even when φ scan is performed with 2θ fixed at around 56°.

According to the above results, in the CAAC-OS film having c-axis alignment, while the directions of a-axes and b-axes are different between crystal parts, the c-axes are aligned in a direction parallel to a normal vector of a formation surface or a normal vector of a top surface. Thus, each metal atom layer arranged in a layered manner observed in the cross-sectional TEM image corresponds to a plane parallel to the a-b plane of the crystal.

Note that the crystal part is formed concurrently with deposition of the CAAC-OS film or is formed through crystallization treatment such as heat treatment. As described above, the c-axis of the crystal is aligned in a direction parallel to a normal vector of a formation surface or a normal vector of a top surface. Thus, for example, in the case where the shape of the CAAC-OS film is changed by etching or the like, the c-axis might not be necessarily parallel to a normal vector of a formation surface or a normal vector of a top surface of the CAAC-OS film.

Further, the degree of crystallinity in the CAAC-OS film is not necessarily uniform. For example, in the case where crystal growth leading to the CAAC-OS film occurs from the vicinity of the top surface of the film, the degree of the crystallinity in the vicinity of the top surface is higher than that in the vicinity of the formation surface in some cases. Further, when an impurity is added to the CAAC-OS film, the crystallinity in a region to which the impurity is added is changed, and the degree of crystallinity in the CAAC-OS film varies depending on regions.

Note that when the CAAC-OS film with an $InGaZnO_4$ crystal is analyzed by an out-of-plane method, a peak of 2θ may also be observed at around 36°, in addition to the peak of 2θ at around 31°. The peak of 2θ at around 36° indicates that a crystal having no c-axis alignment is included in part of the CAAC-OS film. It is preferable that in the CAAC-OS film, a peak of 2θ appear at around 31° and a peak of 2θ do not appear at around 36°.

To manufacture a transistor with a standardized off-state current of 100 zA/μm or lower, a CAAC-OS layer is preferably formed under the following conditions.

For example, the CAAC-OS layer can be deposited by a sputtering method using a polycrystalline oxide semiconductor target. When ions are made to collide with the target, a crystal region included in the target may be separated from the target along the a-b plane; in other words, a particle having a plane parallel to the a-b plane (flat-plate-like particle or pellet-like particle) may flake off from the target. The sputtered particle reaches a substrate while maintaining its crystal structure, whereby the CAAC-OS layer can be deposited.

As an example of a sputtering target, a polycrystalline In—Ga—Zn-based oxide target is described below.

The polycrystalline In—Ga—Zn-based oxide target is made by mixing $InO_X$ powder, $GaO_Y$ powder, and $ZnO_Z$ powder in a predetermined molar ratio, applying pressure, and performing heat treatment at a temperature higher than or equal to 1000° C. and lower than or equal to 1500° C. Note that X, Y, and Z are each a given positive number. Here, the predetermined molar ratio of $InO_X$ powder to $GaO_Y$ powder and $ZnO_Z$ powder is, for example, 2:2:1, 8:4:3, 3:1:1, 1:1:1, 4:2:3, or 3:1:2. The kinds of powder and the molar ratio for mixing powder may be determined as appropriate depending on the desired sputtering target.

By reducing the amount of impurities entering the CAAC-OS layer during the deposition, the crystal structure can be prevented from being broken by the impurities. For example, the concentration of impurities (e.g., hydrogen, water, carbon dioxide, or nitrogen) which exist in the deposition chamber is preferably reduced. Furthermore, the concentration of impurities in a deposition gas is preferably reduced. Specifically, a deposition gas whose dew point is −80° C. or lower, preferably −100° C. or lower is preferably used. Further, it is preferable that the proportion of oxygen in the deposition gas be increased and the power be optimized in order to reduce plasma damage at the deposition. The proportion of oxygen in the deposition gas is, specifically, 30 vol % or higher, preferably 100 vol %.

The substrate heating temperature during the deposition is preferably increased so that migration of flat-plate-like particles sputtered from the target occurs on a formation surface. Migration of the sputtered particles is caused on the formation surface in order that a flat plane of the sputtered particle is attached to the formation surface. The substrate heating temperature is, specifically, higher than or equal to 100° C. and lower than or equal to 740° C., preferably higher than or equal to 200° C. and lower than or equal to 500° C.

This embodiment can be implemented in appropriate combination with any of the other embodiments.

Embodiment 3

In this embodiment, a structure of the liquid crystal element 136 in FIG. 2 is described. As mentioned in Embodiment 2, the structure of the liquid crystal element differs depending on the display mode of a liquid crystal display device.

Figure 10A:
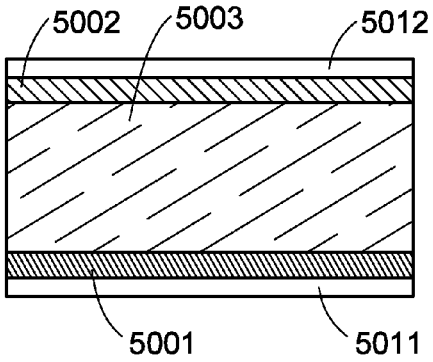
FIGS. 10A to 10D are cross-sectional views showing structural examples of a liquid crystal element in different display modes.
Figure 10B:
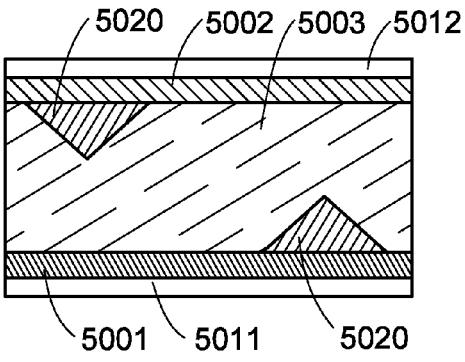
Figure 10C:
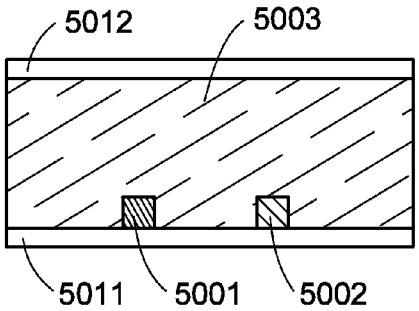
Figure 10D:
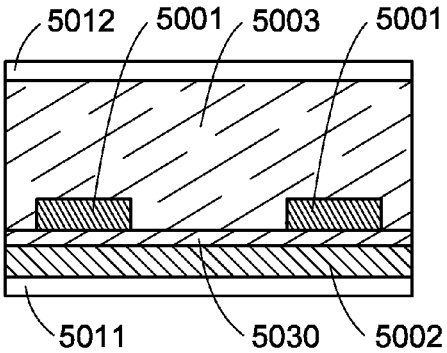

FIGS. 10A to 10D are cross-sectional views showing structural examples of liquid crystal elements in respective display modes. FIG. 10A shows a twisted nematic (TN) mode or a vertical alignment (VA) mode, FIG. 10B shows a multi-domain vertical alignment (MVA) mode, FIG. 10C shows an in-plane-switching (IPS) mode, and FIG. 10D shows a fringe field switching (FFS) mode.

As shown in FIGS. 10A to 10D, the liquid crystal element includes a pixel electrode 5001, a common electrode 5002, and a liquid crystal layer 5003. The liquid crystal layer 5003 is provided between a substrate 5011 and a substrate 5012.

As shown in FIG. 10A, the liquid crystal element has the same structure in the TN mode and the VA mode. In the VA mode liquid crystal display device, liquid crystal molecules in the liquid crystal layer 5003 are aligned vertically to the substrates 5011 and 5012 when there is no electric field.

As shown in FIG. 10B, in the MVA mode liquid crystal element, protrusions 5020 are provided on the pixel electrode 5001 and the common electrode 5002 in order to compensate viewing angle dependence. The alignment of liquid crystal molecules is varied by the protrusions 5020, so that a plurality of regions having different alignment of liquid crystal molecules is formed in one pixel.

As shown in FIG. 10C, in the IPS mode liquid crystal element, the pixel electrode 5001 and the common electrode 5002 are formed over the substrate 5011. In the IPS mode, liquid crystal molecules rotate in parallel to the substrate 5011. The IPS mode is a horizontal electric field mode in which an electric field parallel to the substrate 5011 is formed between the pixel electrode 5001 and the common electrode 5002. The IPS mode is known as a mode with small viewing angle dependence. Further, in the IPS mode, liquid crystal exhibiting a blue phase may be used for the liquid crystal layer 5003. Liquid crystal exhibiting a blue phase does not require an alignment film and has high response speed.

Similarly to the IPS mode, the FFS mode is a horizontal electric field mode and has small viewing angle dependence. As shown in FIG. 10D, in the FFS mode liquid crystal element, the pixel electrode 5001 and the common electrode 5002 are formed over the substrate 5011. The pixel electrode 5001 is formed over the common electrode 5002 with an insulating layer 5030 provided therebetween.

Embodiment 4

Examples of an electronic device including the liquid crystal display device 100 as a display portion are described with reference to FIGS. 11A to 11F. FIGS. 11A to 11F are external views of electronic devices.

Figure 11A:
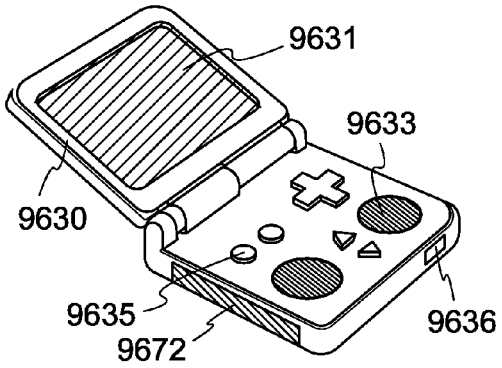
FIGS. 11A to 11F are external views of electronic devices including the liquid crystal display device in FIG. 1 in a display portion.

FIG. 11A is an external view of a portable game machine. The portable game machine includes a housing 9630, a display portion 9631, speakers 9633, operation keys 9635, a connection terminal 9636, a recording medium reading portion 9672, and the like. The portable game machine in FIG. 11A has a function of reading a program or data stored in a recording medium to display it on the display portion

9631, a function of sharing data with another portable game machine by wireless communication, and the like.

Figure 11B:
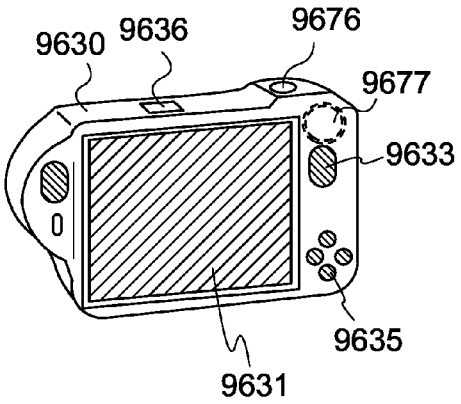

FIG. 11B is an external view of a digital camera. The digital camera includes the housing 9630, the display portion 9631, the speaker 9633, the operation keys 9635, the connection terminal 9636, a shutter button 9676, an image receiving portion 9677, and the like. The digital camera has a function of shooting a still image and/or a moving image, a wireless communication function, a function of correcting the shot image, and the like.

Figure 11C:
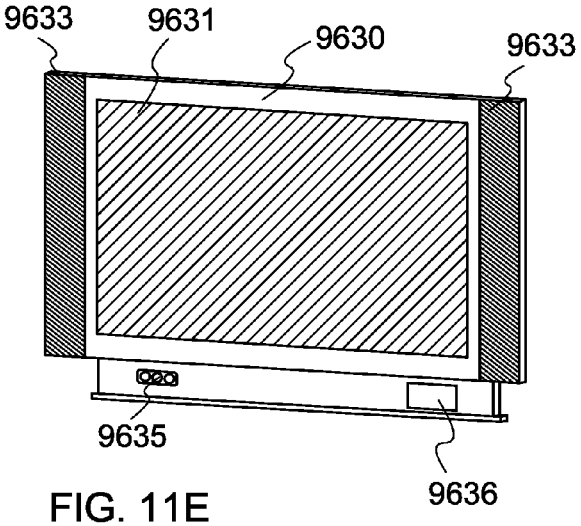

FIG. 11C is an external view of a television set. The television set includes the housing 9630, the display portion 9631, the speakers 9633, the operation keys 9635, the connection terminal 9636, and the like. The television set has a function of converting an electric wave for television into an image signal, a function of converting an image signal into a signal suitable for display, a function of converting the frame frequency of an image signal, and the like.

Figure 11D:
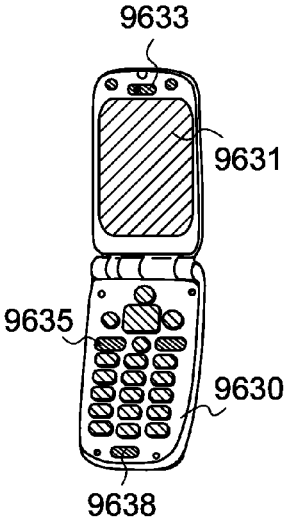

FIG. 11D is an external view of a mobile phone. The mobile phone includes the housing 9630, the display portion 9631, the speaker 9633, the operation keys 9635, a microphone 9638, and the like. The mobile phone has, in addition to a calling function, a function of displaying various kinds of data (e.g., a still image, a moving image, and a text image) on the display portion 9631; a function of displaying a calendar, a date, the time, and the like on the display portion 9631; a function of editing the data displayed on the display portion 9631; a function of processing data by executing software (a program); and the like.

Figure 11E:
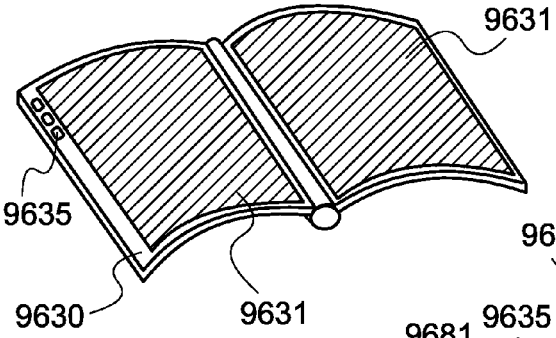

FIG. 11E is an external view of electronic paper. The electronic paper includes the housing 9630, the display portion 9631, the operation keys 9635, and the like. The electronic paper has a function of displaying various kinds of data (e.g., a still image, a moving image, and a text image) on the display portion 9631; a function of displaying a calendar, a date, the time, and the like on the display portion 9631; a function of editing the data displayed on the display portion 9631; a function of processing data by executing various kinds of software (programs); and the like.

Figure 11F:
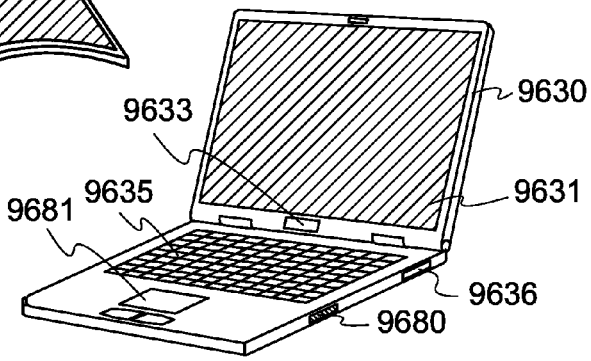

FIG. 11F is an external view of a computer. The computer includes the housing 9630, the display portion 9631, the speaker 9633, the operation keys 9635, the connection terminal 9636, an external connection port 9680, a pointing device 9681, and the like. The computer has a function of displaying various kinds of data (e.g., a still image, a moving image, and a text image) on the display portion 9631, a function of processing data by executing various kinds of software (programs), a communication function such as wireless communication or wired communication, a function of being connected to a computer network with the communication function, and the like.

The electronic device in this embodiment achieves a reduction in power consumption in display operation by including the liquid crystal display device 100 described in Embodiments 1 to 3.

Note that the electronic devices in FIGS. 11A to 11F can have a variety of functions besides those described in this embodiment. This embodiment can be implemented in appropriate combination with any of the structures described in the other embodiments.

This application is based on Japanese Patent Application serial No. 2012-175997 filed with Japan Patent Office on Aug. 8, 2012, the entire contents of which are hereby incorporated by reference.

What is claimed is:

1. A liquid crystal display device comprising:
- a scan line to which a scan signal is input;
- a data line to which a data signal is input;
- a plurality of pixels each comprising:
  - a liquid crystal element including liquid crystal, a pixel electrode, and a common electrode, and
  - a switching element configured to control electrical conduction between the pixel electrode and the data line in accordance with the scan signal;
- a display portion including the plurality of pixels;
- a scan line driver circuit configured to output the scan signal to the scan line;
- a data line driver circuit configured to output the data signal to the data line;
- a first control circuit configured to control the scan line driver circuit and the data line driver circuit; and
- a second control circuit configured to control a polarity of the data signal input to the data line,
- wherein the second control circuit generates a polarity control signal that inverts the polarity of the data signal every m frame periods (m is an integer greater than or equal to 2),
- wherein the data line driver circuit processes an image signal to generate the data signal having the polarity corresponding to the polarity control signal,
- wherein the first control circuit performs or stops rewriting of the plurality of pixels in accordance with the image signal, and
- wherein a voltage equal to a voltage of the common electrode is applied to the data line for at least one frame period in response to a change in a potential level of the polarity control signal, the data signal with an inverted polarity is applied to the data line for one frame period after applying the voltage equal to the voltage of the common electrode to the data line, and no signal is supplied to the data line for frame periods just after applying the data signal with the inverted polarity to the data line.

2. The liquid crystal display device according to claim 1, wherein the first control circuit stops rewriting of the plurality of pixels when determining that there is no change in data of the image signal.

3. The liquid crystal display device according to claim 1, wherein the switching element is a transistor including an oxide semiconductor layer in which a channel formation region is formed.

4. An electronic device comprising the liquid crystal display device according to claim 1.

5. The electronic device according to claim 4, wherein the electronic device is one selected from the group consisting of a portable game machine, a digital camera, a television set, a mobile phone, an electronic paper, and a computer.

6. A method for driving a liquid crystal display device, the liquid crystal display device comprising:
- a scan line to which a scan signal is input;
- a data line to which a data signal is input;
- a plurality of pixels each comprising:
  - a liquid crystal element including liquid crystal, a pixel electrode, and a common electrode, and
  - a switching element configured to control electrical conduction between the pixel electrode and the data line in accordance with the scan signal;
- a display portion including the plurality of pixels;
- a scan line driver circuit configured to output the scan signal to the scan line; and a data line driver circuit configured to receive a polarity control signal and output the data signal to the data line, wherein the method comprises the steps of:

outputting the data signal whose polarity is inverted every m frame periods (m is an integer greater than or equal to 2) to the data line; and rewriting the plurality of pixels every m frame periods in a period during which an image without motion is displayed in the display portion, wherein a voltage equal to a voltage of the common electrode is applied to the data line for at least one frame period in response to a change in a potential level of the polarity control signal, the data signal with an inverted polarity is applied to the data line for one frame period after applying the voltage equal to the voltage of the common electrode to the data line, and no signal is supplied to the data line for frame periods just after applying the data signal with the inverted polarity to the data line.

7. The method for driving a liquid crystal display device according to claim 6, wherein the switching element is a transistor including an oxide semiconductor layer in which a channel formation region is formed.

* * * * *